US005082822A

United States Patent [19]

Uytterhoeven et al.

[11] Patent Number: 5,082,822

[45] Date of Patent: Jan. 21, 1992

[54] SUBBING LAYER FOR DYE-DONOR ELEMENT USED IN THERMAL DYE TRANSFER

[75] Inventors: Herman J. Uytterhoeven, Bonheiden; Etienne A. Van Thillo, Essen, both of Belgium

[73] Assignee: AGFA-Gevaert, N.V., Mortsel, Belgium

[21] Appl. No.: 623,564

[22] Filed: Dec. 7, 1990

[30] Foreign Application Priority Data

Dec. 18, 1989 [EP] European Pat. Off. ... EP 892-3233.5

[51] Int. Cl.[5] ..... B41M 5/035; B41M 5/26

[52] U.S. Cl. ..... 503/227; 8/471; 428/195; 428/480; 428/913; 428/914

[58] Field of Search ..... 8/471; 428/195, 336, 428/480, 913, 914; 503/227

[56] References Cited

U.S. PATENT DOCUMENTS 4,695,288 9/1987 Ducharme ..... 8/471

*Primary Examiner*—Bruce H. Hess

*Attorney, Agent, or Firm*—Breiner & Breiner

[57] ABSTRACT

Dye-donor element for use in thermal dye sublimation transfer methods, said element comprising a polyethylene terephthalate support having thereon in the order given a subbing layer and a dye/binder layer comprising a dye dispersed in a binder, wherein said subbing layer comprises at least one aromatic polyol as swelling agent for polyethylene terephthalate and a binder that is soluble in organic solvents.

8 Claims, No Drawings

SUBBING LAYER FOR DYE-DONOR ELEMENT USED IN THERMAL DYE TRANSFER

BACKGROUND OF THE INVENTION

1. Field of the Invention

The present invention relates to dye-donor elements for use in thermal dye sublimation transfer methods, the dye-donor elements comprising a subbing layer that improves the adhesion between the polymeric support and the dye/binder layer.

2. Description of the Prior Art

Thermal transfer methods have been developed to make prints from electronic pattern information signals e.g. from pictures that have been generated electronically by means of a colour video camera. To make such prints the electronic picture can be subjected to colour separation with the aid of colour filters. The different colour selections thus obtained can then be converted into electric signals, which can be processed to form cyan, magenta, and yellow electrical signals. The resulting electrical colour signals can then be transmitted to a thermal printer. To make the print a dye-donor element having repeated separate areas of cyan, magenta, and yellow dye is placed in face-to-face contact with a receiving sheet and the resulting sandwich is inserted between a thermal printing head and a platen roller. The thermal printing head, which is provided with a plurality of juxtaposed heat-generating resistors, can selectively supply heat to the back of the dye-donor element. For that purpose it is heated up sequentially in correspondence with the cyan, magenta, and yellow electrical signals, so that dye from the selectively heated regions of the dye-donor element is transferred to the receiver sheet and forms a pattern thereon, the shape and density of which are in accordance with the pattern and intensity of the heat supplied to the dye-donor element.

The dye-donor element usually comprises a very thin support e.g. a polyester support coated on one side with a slipping layer that provides a lubricated surface against which the thermal printing head can pass without suffering abrasion and on the opposite side with a dye/binder layer, which contains the printing dyes in a form that can be released in varying amounts depending on, as mentioned above, how much heat is applied to the dye-donor element.

A very thin polymeric support is necessary to allow the heat generated selectively by the thermal printing head to pass effectively through the support to the dye/binder layer and cause dye to transfer from the selectively heated regions of that layer to the receiver sheet. However, as a result of the extreme thinness of the support the dye/binder layer tends to delaminate under the influence of the heat supplied by the printing head.

To prevent delamination a subbing layer can be provided between the support and the dye/binder layer. Various subbing layers have been described for photographic applications where the adhesion between a polymeric support and a hydrophilic colloid layer, generally gelatin layers had to be improved. Unfortunately, many of them are inappropriate for use in thermal dye sublimation transfer methods. An attempt was made to provide a subbing layer for use in thermal dye sublimation transfer methods. In EP-A 268,179 a subbing layer has been proposed, which comprises a polymer having an inorganic backbone e.g. an organic titanate or titanium alkoxide. However, it was found that the addition of organic titanates did not adequately solve the adhesion problems.

SUMMARY OF THE INVENTION

It is therefore an object of the present invention to provide a dye-donor element for use in thermal dye sublimation transfer methods, said element comprising a subbing layer improving the adhesion between the polymeric support and the dye/binder layer and thus making possible an easy and effective thermal dye transfer.

This and other objects are achieved by providing a dye-donor element for use in thermal dye sublimation transfer methods, said element comprising a polyethylene terephthalate support having thereon in the order given a subbing layer and a dye/binder layer comprising a dye dispersed in a binder, wherein said subbing layer comprises at least one aromatic polyol swelling agent for polyethylene terephthalate and a binder that is soluble in organic solvents.

It has been established that a subbing layer comprising at least one aromatic polyol provides a superior adhesive bond between a polyethylene terephthalate support and a dye/binder layer having a high content of dye that may be up to about 70% by weight of the layer composition.

DETAILED DESCRIPTION OF THE INVENTION

The dye-donor element according to the present invention comprises a support, which preferably is coated on one side with an adhesive layer that is covered itself with a slipping layer to prevent the thermal printing head from sticking to the dye-donor element, the opposite side of the support being covered in the given order with a subbing layer and a dye/binder layer, which contains the printing dyes in a form that can be released in varying amounts depending on, as mentioned above, how much heat is applied to the dye-donor element, said subbing layer comprising an aromatic polyol or a mixture of such polyols and a binder that is soluble in organic solvents.

Examples of aromatic polyols that can be used advantageously in the subbing layer to improve the adhesive bond between the support and the dye/binder layer are i.a. hydroquinone, pyrocatechol, 3-methoxy-catechol, 4-methyl-catechol, 3-methyl-6-isopropyl-catechol, resorcinol, 2-nitro-resorcinol, phloroglucinol, pyrogallol, bisphenol A, and dihydroxy-naphthalenes such as 1,3-dihydroxy-naphthalene and 1,6-dihydroxy-naphthalene.

The binder for the subbing layer should be soluble in organic solvents such as chlorinated hydrocarbon solvents e.g. methylene chloride. Preferably, however, the binder is soluble in non-chlorinated ecologically acceptable solvents such as e.g. methanol, 3-methoxy-propanol, ethyl methyl ketone, acetone, ethyl acetate, methyl acetate, propyl acetate, isopropyl acetate, butyl acetate, ethyl formiate, methyl propionate, ethyl propionate, diethyl ketone, diethyl carbonate, n-propyl methyl ketone, diisopropyl ether, cyclohexane, ligroin, formamide, dimethylformamide, tetrahydrofuran, dioxan, and mixtures of these solvents.

Suitable binders that are soluble in organic solvents and that can be used for the subbing layer can be chosen from the classes of polyester resins, polyurethan resins, polyester urethan resins, modified dextrans, modified cellulose, and copolymers comprising recurring units such as i.a. vinyl chloride, vinylidene chloride, vinyl acetate, acrylonitrile, methacrylate, acrylate, butadiene, and styrene.

Most of these binders are commercially available products such as those identified hereinafter.

Suitable modified dextrans are the reaction products of dextran and alkyl or aryl haloformates, the synthesis of which has been described in U.S. Pat. No. 4,879,209.

The composition comprising at least one aromatic polyol, a binder, and an organic solvent, preferably an ecologically acceptable organic solvent, has an ink-like nature and can thus easily be printed on the support by printing techniques such as a gravure process. The composition may comprise one or more polymers having a high molecular weight for the purpose of increasing the viscosity of the composition and thus improving its printing behaviour. The presence of such polymer(s) does not impair the adhesive bond accomplished according to the present invention between the support and the dye/binder layer. The composition for coating the subbing layer may comprise other additives e.g. surface-active agents.

According to a preferred embodiment of the present invention the subbing layer comprises at least one aromatic polyol and a polyester resin binder that is soluble in a non-chlorinated organic solvent such as ethyl methyl ketone.

According to an even more preferred embodiment of the present invention the subbing layer comprises pyrocatechol and a polyester resin binder that is soluble in a non-chlorinated organic solvent.

The subbing layer of the present invention can be used in any concentration that leads to an improved adhesive bond between the support and the dye/binder layer. Favourable results are usually obtained at a coating ratio of the subbing layer composition of from 0.01 to 1 g per m2.

The aromatic polyol and the binder of the subbing layer can be used in a ratio by weight of from 20:1 to 0.2:1, preferably of from 5:1 to 0.5:1.

The binder of the subbing layer can be employed in any concentration that leads to an improved adhesive bond between the support and the dye/binder layer. Good results are usually obtained with a binder weight of from 0.05 to 5 g per m2 of dry subbing layer.

In general, the thickness of the dry subbing layer ranges from 0.1 to 2 μm, preferably from 0.2 to 0.5 μm.

The dye/binder layer is formed preferably by dissolving printing dyes, a binder, and other optional components in a suitabl solvent or solvent mixture to form an ink-like composition that is applied to the subbing layer of the present invention on a support, preferably by printing according to a gravure process, and dried.

The binder of the dye/binder layer is one of the known binder resins such as e.g. cellulose derivatives like ethyl cellulose, hydroxyethyl cellulose, ethylhydroxy cellulose, ethylhydroxyethyl cellulose, hydroxypropyl cellulose, methyl cellulose, cellulose acetate, cellulose acetate formate, cellulose acetate propionate, cellulose acetate butyrate, cellulose acetate pentanoate, cellulose acetate hexanoate, cellulose acetate heptanoate, cellulose acetate benzoate, cellulose acetate hydrogen phthalate, and cellulose triacetate; vinyl-type resins like polyvinyl alcohol, polyvinyl acetate, polyvinyl butyral, polyvinyl pyrrolidone, polyvinyl acetoacetal, and polyacrylamide; polymers and copolymers derived from acrylates and acrylate derivatives, such as polyacrylic acid, polymethyl methacrylate, and styrene-acrylate copolymers; polyester resins; polycarbonates; poly(styrene-co-acrylonitrile); polysulfones; polyphenylene oxide; organosilicones such as polysiloxanes; epoxy resins and natural resins, such as gum arabic, dextrans and modified dextrans, and mixtures of these binder resins.

The binder of the dye/binder layer can be used in widely varying concentrations. In general, good results are obtained when the dye/binder layer comprises 0.1 to 5 g of polymeric binder medium per m2.

Any dye can be used in the dye/binder layer provided it is easily transferable to the receiver sheet by the action of heat and has a satisfactory fastness to light. Suitable dyes are those described in e.g. EP-A 209,990, EP-A 209,991, EP-A 216,483, EP-A 218,397, EP-A 227,095, EP-A 227,096, EP-A 229,374, EP-A 257,577, EP-A 257,580, JP 84/78894, JP 84/78895, JP 84/78896, JP 84/227,490, JP 84/227,948, JP 85/27594, JP 85/30391, JP 85/229,787, JP 85/229,789, JP 85/229,790, JP 85/229,791, JP 85/229,792, JP 85/229,793, JP 85/229,795, JP 86/41596, JP 86/268,493, JP 86/268,494, JP 86/268,495, and JP 86/284,489.

The dye/binder layer comprises from 0.05 to 1 g of printing dye per m2.

The dye/binder layer usually has a thickness of 0.2 to 5 μm, preferably of 0.4 to 2 μm.

The dye/binder layer can also comprise other components such as e.g. curing agents, preservatives, and other ingredients, which have been described in EP-A 0,133,011, EP-A 0,133,012, and EP-A 0,111,004.

The dye/binder layer may comprise at least one releasing agent. Even higher transfer densities can be obtained in that case. Suitable releasing agents are i.a. solid waxes, fluorine-or phosphate-containing surfactans, and silicone oils.

Any material can be used as the support for the dye-donor element provided it is dimensionally stable and capable of withstanding the temperatures involved, i.e. up to 400° C. over a period of up to 20 msec, and is yet thin enough to transmit heat supplied to one side through to the dye on the other side to effect transfer to the receiver sheet within such short periods, typically from 1 to 10 msec. Such materials include polyesters such as polyethylene therephthalate, polyamides, polyacrylates, polycarbonates, cellulose esters, fluorinated polymers, polyethers, polyacetals, polyolefins, polyimides, glassine paper, and condenser paper. In accordance with the present invention preference is given, however, to a support comprising polyethylene terephthalate. In general, the support has a thickness of 2 to 30 μm.

A dye barrier layer comprising a hydrophilic polymer can be provided on the subbing layer of the present invention before the dye/binder layer is applied thereto. The dye barrier layer may contain any hydrophilic material that is useful for the intended purpose. In general, good results have been obtained with polyacrylamide, polyisopropyl acrylamide, butyl methacrylate-grafted gelatin, ethyl methacrylate-grafted gelatin, ethyl acrylate-grafted gelatin, cellulose monoacetate, methylcellulose, polyvinyl alcohol, polyethylene imine, polyacrylic acid, a mixture of polyvinyl alcohol and polyvinyl acetate, a mixture of polyvinyl alcohol and polyacrylic acid, or a mixture of cellulose monoacetate and polyacrylic acid. Suitable dye barrier layers have been described in e.g. EP-A 0,227,091 and EP-A 0,228,065.

Preferably, the reverse side of the polyethylene terephthalate support can be coated with a slipping layer to prevent the printing head from sticking to the dye-donor element. Such a slipping layer would comprise a lubricating material such as a surface-active agent, a liquid lubricant, a solid lubricant, or mixtures thereof, with or without a polymeric binder. The surface-active agents may be any agents known in the art such as carboxylates, sulfonates, phosphates, aliphatic amine salts, aliphatic quaternary ammonium salts, polyoxyethylene alkyl ethers, polyethylene glycol fatty acid esters, and fluoroalkyl $C_2$–$C_{20}$ aliphatic acids. Examples of liquid lubricants include silicone oils, synthetic oils, saturated hydrocarbons, and glycols. Examples of solid lubricants include various higher alcohols such as stearyl alcohol, fatty acids and fatty acid esters. Suitable slipping layers have been described in e.g. EP-A 0,138,483, EP-A 0,227,090, U.S. Pat. No. 4,567,113, U.S. Pat. No. 4,572,860, and U.S. Pat. No. 4,717,711.

To improve the adhesion of the slipping layer to the reverse side of the polyethylene terephthalate support a subbing layer comprising at least one aromatic polyol swelling agent for polyethylene terephthalate and a binder that is soluble in organic solvents can also be provided between the support and the slipping layer.

The dye-donor element can be used in sheet form or in the form of a continuous roll or ribbon. If a continuous roll or ribbon is employed, it preferably has sequential repeating areas of different dyes, such as magenta and/or cyan and/or yellow and/or black dyes.

The support of the receiver sheet to be used in combination with the dye-donor element may be a transparant film of e.g. polyethylene terephthalate, a polyether sulfone, a polyimide, a polycarbonate, a cellulose ester, and a polyvinyl alcohol-coacetal. The support may also be a reflecting one such as e.g. white polyester i.e. white-pigmented polyester and paper coated with white-pigmented polyolefin.

To avoid poor adsorption of the transferred dye to the support of the receiver sheet, this support must be coated with a special surface, generally known as dye-image-receiving layer, into which the dye can diffuse more readily. The dye image-receiving layer may comprise e.g. a polycarbonate, a polyurethane, a polyester, a polyamide, polyvinyl chloride, polystyrene-coacrylonitrile, polycaprolactone, a modified dextran, and mixtures thereof. Suitable dye-image-receiving layers have been described in e.g. EP-A 0,133,011, EP-A 0,133,012, EP-A 0,144,247, EP-A 0,227,094, and EP-A 0,228,066.

To improve the adhesion of the dye-image-receiving layer to the support of the receiver sheet in case it is a polyester support, this support may also be provided with a subbing layer comprising at least one aromatic polyol and a binder.

UV-absorbers and/or antioxidants may be incorporated into the dye-image-receiving layer for improving the fastness to light and other stabilities of the recorded images.

A releasing agent that aids in separating the receiver sheet from the dye-donor element after transfer can be used in the receiver sheet or in the dye/binder layer of the dye-donor element. Solid waxes, fluorine- or phosphate-containing surfactants, and silicone oils can be used as releasing agent. A suitable releasing agent has been described in e.g. EP-A 0,133,012, JP 85/19138, and EP-A 0,227,092.

When the dye transfer is performed for but one single colour, a monochrome dye transfer image is obtained. A multicolour image can be obtained by using a dye-donor element containing three or more primary colour dyes and sequentially performing the process steps described above for each colour. The above sandwich of dye-donor element and receiver sheet is then formed on three or more occasions during the time heat is being supplied by the thermal printing head. After the first dye has been transferred, the elements are peeled apart. A second dye-donor element or another area of the dye-donor element with a different dye area is then brought in register with the receiver sheet and the process is repeated. The third colour and optionally further colours are obtained in the same manner.

In addition to thermal printing heads, infrared flash and heated pins can be used as a heat source for supplying the heat energy. Thermal printing heads that can be used to transfer dye from the dye-donor elements of the present invention to a receiver sheet are commercially available. Suitable thermal printing heads are e.g. a Fujitsu Thermal Head (FTP-040 MCS001), a TDK Thermal Head F415 HH7-1089, and a Rohm Thermal Head KE 2008-F3.

The following examples illustrate the present invention.

EXAMPLE 1

A number of identical polyethylene terephthalate supports having a thickness of a 5 μm were treated as follows.

A first series of these supports (Tests No. 01 to 05) were not provided with a subbing layer.

In Tests No. 06 and 07 a known subbing layer was printed by means of a doctor blade or a gravure press on these polyethylene terephthalate supports.

In Tests N° 08 to 12 a subbing layer comprising a binder but no aromatic polyol was printed by means of a doctor blade or a gravure press on these supports.

In Tests No. 13 and 14 a subbing layer comprising a binder and an aliphatic alcohol was printed.

In Tests No. 15 to 17 a subbing layer comprising a binder and an aromatic monoalcohol was printed.

In Test No. 18 a subbing layer comprising a binder and an aromatic ether was printed.

In Tests No. 19 to 63 a subbing layer comprising a binder and an aromatic polyol according to the present invention was printed.

The composition for printing the subbing layer was prepared by dissolving binder and polyol (or comparison alternatives) in a weight ratio of 1:5 (unless otherwise indicated in Table 1 hereinafter behind the polyol used) in a volume of solvent sufficient to form a printable composition. The binder, the polyol (or the comparison alternatives), and the solvent were as indicated in Table 1. The thickness of the printed subbing layer in wet condition was 10 μm.

Subsequently, each of the resulting supports was provided with a dye/binder layer as follows.

An amount of 10 g of dye and 10 g of binder, both as identified in Table 1 were dissolved in 100 g of ethyl methyl ketone. The resulting ink-like composition was also printed by means of a doctor blade or a gravure press. The dry dye/binder layer had a weight of 2.5 g per m2.

The adhesion of each dye/binder layer to the polyethylene terephthalate support was tested by pressing a pressure-adhesive tape Tesapack 4122 (Tesa) to the dry dye/binder layer at room temperature and then immediately tearing the tap off at an acute angle. The condition of the dye/binder layer after the tearing off of the tape was evaluated visually. A value of 0 was attributed in case no visual damage had been done to the dye/binder layer, thus proving that an excellent bond existed between the support and the dye/binder layer. A value of 1 was given when only tiny fragments of the dye/binder layer had been torn out, a value of 2 when less than 50% of the surface had been damaged or delaminated, 3 for more than 50% delamination, and 4 in case of complete delamination. The values 2 to 4 were considered to be insatisfactory. The value 0 was aimed at.

The following is an explanation of dyes, binders, and solvents that were used in the tests and are listed in Table 1.

YD01 is Macrolex Gelb, which is a yellow dye corresponding to the following structural formula:

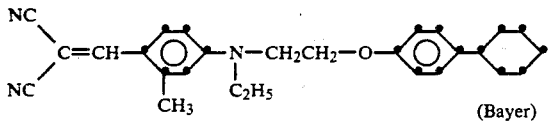

(Bayer)

CD01 is the cyan dye corresponding to the following structural formula:

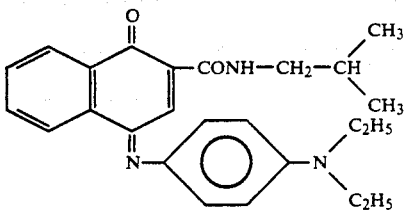

MD01 is the magenta dye corresponding to the following structural formula:

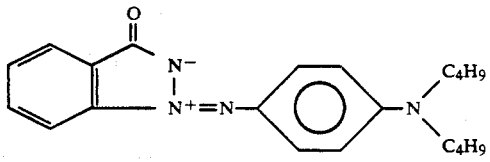

MD02 is Resolin Rot F3Bs Komp. II, which is the magenta dye corresponding to the following structural formula:

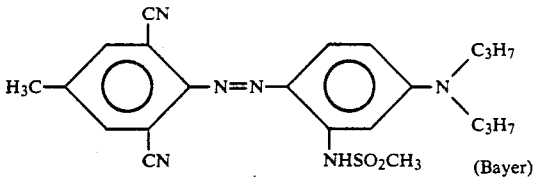

(Bayer)

TIT 01 is tetra-2-ethylhexyl-titanate (duPont)
TIT 02 is tetra-isopropyl-titanate (Suchard)
Polyco 330 is co(styrene/maleic anhydride) (Baden Co.)
Solvic is co(vinyl chloride/vinyl acetate) (Solvic)
Rhenoflex 63 is post-chlorinated polyvinyl chloride (Dynamit Nobel)
Luran 378F is co(styrene/acrylonitrile)(Tg=96° C.) (BASF)
Lustran Q1355 is co(styrene/acrylonitrile/butadiene) (Monsanto)
COA is co(styrene/acrylonitrile)
Vitel PE 200 is a polyester (Tg=67° C.) (Goodyear)
Dynapol L206 is a polyester(Tg=67° C.)/m.p.90°-150° C.) (Dynamit Nobel)
Desmocoll 130 is a polyester-urethan (Bayer)
duPont 49000 is a polyester (Tg=30° C./m.p. 130° C.) (duPont)
Desmocoll 540 is a polyester-urethan (Bayer)
Vitel VPE 5833A is a polyester (Tg=48° C.) (Goodyear)
Vitel PE 222 is a copolyester (Tg=47° C.) (Goodyear)
Vylon 200 is a copolyester (Tg=67° C.) (Toyobo Co.)
Desmocoll 530 is a polyester-urethan (Bayer)
CAb 171 15-s is cellulose acetate butyrate (Eastman)
DEC is dextran ethyl carbonate prepared as described in U.S. Pat. No. 4,879,209
CHON is cyclohexanon
EMK is ethyl methyl ketone
GAME is gallic acid methyl ester
HQ is hydroquinone
IPOH is isopropanol
3-MIC is 3-methyl-6-isopropyl-catechol
4-MCC is 4-methylcatechol
OPP is o-phenylphenol
PCC is pyrocatechol
PHP is phloroglucinol
PPP is p-phenylphenol
RDME is resorcin dimethyl ether
ROL is resorcinol
TCNP is trichloronitropropanol
BAL is benzyl alcohol The results of the tests are listed in the following Table 1.

TABLE 1

| Test | Subbing layer | | | Dye/binder layer | | Tape test |
|---|---|---|---|---|---|---|
| N° | Binder | Polyol | Solvent | Dye | Binder | evaluation |
| 01 | none | none | none | YD01 | Luran 378F | 3 |
| 02 | none | none | none | MD02 | Vitel VPE 5833A | 3 |
| 03 | none | none | none | MD02 | CAb171 15-s | 4 |
| 04 | none | none | none | MD01 | Vitel PE 222 | 4 |
| 05 | none | none | none | MD01 | Lustran Q1355 | 4 |
| 06 | none | TIT 01 | IPOH | MD02 | CAb171 15-s | 4 |
| 07 | none | TIT 02 | IPOH | MD02 | CAb171 15-s | 4 |
| 08 | duPont 49000 | none | CHON | CD01 | Vitel PE 222 | 4 |
| 09 | duPont 49000 | none | CHON | CD01 | Luran 378F | 4 |
| 10 | Vitel PE 200 | none | EMK | CD01 | Vitel PE 222 | 3–4 |
| 11 | Vitel PE 222 | none | EMK | CD01 | Vitel PE 222 | 4 |
| 12 | Desmocoll 530 | none | EMK | CD01 | Lustran Q1355 | 3–4 |

TABLE 1-continued

| Test | Subbing layer | | | Dye/binder layer | | Tape test |
|---|---|---|---|---|---|---|
| N° | Binder | Polyol | Solvent | Dye | Binder | evaluation |
| 13 | Vitel PE 222 | TCNP | EMK | CD01 | Vitel PE 222 | 4 |
| 14 | CAb171 15-s | TCNP | EMK | MD02 | CAb171 15-s | 4 |
| 15 | Dynapol L206 | BAL | EMK | CD01 | Vitel PE 222 | 4 |
| 16 | Dynapol L206 | OPP | EMK | CD01 | Lustran Q1355 | 3–4 |
| 17 | Dynapol L206 | PPP | EMK | CD01 | Lustran Q1355 | 2–3 |
| 18 | Vitel PE 222 | RDME | EMK | CD01 | Vitel PE 222 | 3–4 |
| 19 | duPont 49000 | ROL | CHON | CD01 | Vitel PE 222 | 0 |
| 20 | duPont 49000 | ROL | CHON | CD01 | Rhenoflex 63 | 1–2 |
| 21 | duPont 49000 | ROL | CHON | MD01 | Vitel PE 222 | 0 |
| 22 | Vitel PE 200 | ROL | EMK | CD01 | Vitel PE 222 | 0 |
| 23 | Vitel PE 222 | ROL | EMK | CD01 | Vitel PE 222 | 0 |
| 24 | Vitel PE 222 | ROL (1:2) | EMK | CD01 | Vitel PE 222 | 0–1 |
| 25 | Vitel PE 222 | ROL | EMK | MD01 | Vitel PE 222 | 0–1 |
| 26 | Vitel PE 222 | ROL (1:2) | EMK | MD01 | Vitel PE 222 | 0–1 |
| 27 | Vitel PE 222 | ROL (1:1) | EMK | MD01 | Vitel PE 222 | 0–1 |
| 28 | Vitel PE 222 | ROL | EMK | CD01 | Solvic | 0–1 |
| 29 | Vitel PE 222 | ROL | EMK | CD01 | Lustran Q1355 | 0 |
| 30 | CAb171 15-s | ROL | EMK | CD01 | Vitel PE 222 | 0 |
| 31 | CAb171 15-s | ROL | EMK | MD01 | Vitel PE 222 | 0 |
| 32 | CAb171 15-s | ROL | EMK | YD01 | Luran 378F | 0 |
| 33 | CAb171 15-s | ROL | EMK | MD02 | CAb171 15-s + Luran 378F (4:1) | 0 |
| 34 | Vitel PE 222 | PCC | EMK | CD01 | Vitel PE 222 | 0 |
| 35 | Vitel PE 222 | PCC (1:3) | EMK | CD01 | Vitel PE 222 | 0 |
| 36 | Vitel PE 222 | PCC | EMK | MD01 | Vitel PE 222 | 0 |
| 37 | Vitel PE 222 | PCC (1:3) | EMK | MD01 | Vitel PE 222 | 0 |
| 38 | Vitel PE 222 | PCC | EMK | CD01 | Lustran Q1355 | 0 |
| 39 | Vitel PE 222 | PCC (1:3) | EMK | CD01 | Lustran Q1355 | 0 |
| 40 | Vitel PE 222 | PCC | EMK | MD01 | Lustran Q1355 | 0 |
| 41 | Vitel PE 222 | PCC (1:3) | EMK | MD01 | Lustran Q1355 | 0 |
| 42 | Vylon 200 | PCC | EMK | CD01 | Lustran Q1355 | 0 |
| 43 | Dynapol L206 | PCC | EMK | CD01 | Lustran Q1355 | 0–1 |
| 44 | Dynapol L206 | PCC (1:1) | EMK | CD01 | Lustran Q1355 | 0–1 |
| 45 | Dynapol L206 | PCC | EMK | CD01 | Lustran Q1355 + nitrocellulose (1:1) | 0 |
| 46 | Dynapol L206 | PCC | EMK | CD01 | Lustran Q1355 + Polyco 330 (1:1) | 0–1 |
| 47 | Dynapol L206 | PCC | EMK | CD01 | Lustran Q1355 + DEC (9:1) | 0 |
| 48 | Dynapol L206 | PCC | EMK | CD01 | Desmocoll 530 | 0 |
| 49 | Dynapol L206 | PCC | EMK | CD01 | Lustran Q1355 + Desmocoll 530 (4:1) | 0 |
| 50 | Dynapol L206 | PCC | EMK | CD01 | Lustran Q1355 + Desmocoll 530 (2:1) | 0 |
| 51 | Desmocoll 540 | PCC | EMK | CD01 | Lustran Q1355 | 0 |
| 52 | Dynapol L206 | PCC | EMK | CD01 | Lustran Q1355 + Desmocoll 540 (1:1) | 0 |
| 53 | Dynapol L206 | PCC | EMK | CD01 | Lustran Q1355 + COA (1:1) | 0 |
| 54 | Desmocoll 130 | PCC | EMK | CD01 | Lustran Q1355 | 0 |
| 55 | Desmocoll 530 | PCC | EMK | CD01 | Lustran Q1355 | 0 |
| 56 | Desmocoll 530 | PCC | EMK | CD01 | Lustran Q1355 + COA (9:1) | 0 |
| 57 | Vitel PE 222 | Bisphenol A | EMK | CD01 | Vitel PE 222 | 1–2 |
| 58 | Vitel PE 222 | PHP | EMK | CD01 | Vitel PE 222 | 0–1 |
| 59 | Vitel PE 222 | pyrogallol | EMK | CD01 | Vitel PE 222 | 0 |
| 60 | Dynapol L206 | HQ | EMK | CD01 | Lustran Q1355 | 0–1 |
| 61 | Dynapol L206 | 4-MCC | EMK | CD01 | Lustran Q1355 | 0 |
| 62 | Dynapol L206 | 3-MIC | EMK | CD01 | Lustran Q1355 | 0 |
| 63 | Dynapol L206 | GAME | EMK | MD01 | Lustran Q1355 | 1–2 |

The above results show that:

the absence of a subbing layer (Tests No. 01 to 05) leads to very bad adhesion results, the use of organic titanates (Tests No. 06 and 07) in the subbing layer leads to very bad adhesion results, the use of a binder alone without aromatic polyol (Tests No. 08 to 12) in the subbing layer leads to very bad adhesion results, the use of an aliphatic alcohol (Tests No. 13 and 14) or aromatic monoalcohols (Tests No. 15 to 17) or an aromatic ether (Test No. 18) also leads to bad adhesion results, the use of an aromatic polyol in accordance with the present invention (Tests No. 19 to 63) leads to very good adhesion results.

EXAMPLE 2

In order to make dye-donor elements several identical polyethylene terephthalate supports having a thickness of 5 μm were treated as follows.

To avoid sticking of each dye-donor element to the thermal printing head the rear side of each polyethylene terephthalate support was provided with a slipping layer. However, to improve the adhesion of the slipping layer to the support a subbing layer was provided in between. The rear side of each polyethylene terephthalate support thus carried in the given order a subbing layer and a slipping layer, both applied thereto by printing with a doctor blade or a gravure press.

The composition for printing the subbing layers of Tests No. 64 to 66 (see Table 2) was prepared by dissolving binder and polyol in a weight ratio of 1:5 (unless otherwise indicated in Table 2 between parentheses behind the polyol used) in a volume of solvent sufficient to form a printable composition. The binder, the polyol, and the solvent were as indicated in Table 2. The thickness of the printed subbing layer in wet condition was 10 μm.

Subsequently, each of the resulting supports was provided with a solution for forming a slipping layer, said solution comprising 10 g of the above-mentioned binder Lustran Q1355 (Monsanto), 1 g of polysiloxane polyether copolymer sold under the trade name TEGO-GLIDE 410 by T.H. Goldschmidt, and sufficient ethyl methyl ketone solvent to adjust the weight of the solution to a total of 100 g. The thickness of the printed subbing layer in wet condition was 10 μm. The resulting layer was dried by evaporation of the solvent.

The other side of each of the polyethylene terephthalate supports was provided with a subbing layer and a dye/binder layer as described in Example 1 (Test No. 40).

The adhesion of the slipping layer to the polyethylene terephthalate support was tested by pressing a tape to the dry slipping layer and tearing off as described in Example 1. The condition of the slipping layer after the tearing off of the tape was evaluated as described in Example 1.

The results of the tests are listed in Table 2.

TABLE 2

| Test | Subbing layer | | | Tape test |
|---|---|---|---|---|
| N° | Binder | Polyol | Solvent | evaluation |
| 64 | duPont 49000 | ROL (1:1) | CHON | 0–1 |
| 65 | Vitel PE 222 | ROL | EMK | 0 |
| 66 | Vitel PE 222 | PCC | EMK | 0 |

The above results show that the adhesion of the slipping layer to the polyethylene terephthalate support is very good.

We claim:

1. Dye-donor element for use in thermal dye sublimation transfer methods, said element comprising a polyethylene terephthalate support having thereon in the order given a subbing layer and a dye/binder layer comprising a dye dispersed in a binder, wherein said subbing layer comprises at least one aromatic polyol swelling agent for polyethylene terephthalate and a binder that is soluble in organic solvents.

2. A dye-donor element according to claim 1, wherein said binder is a polyester resin binder that is soluble in a non-chlorinated organic solvent.

3. A dye-donor element according to claim 1, wherein said subbing layer comprises pyrocatechol and a polyester resin binder that is soluble in a non-chlorinated organic solvent.

4. A dye-donor element according to claim 1, wherein said aromatic polyol and said binder are used in a ratio by weight of from 5:1 to 05:1.

5. A dye-donor element according to claim 1, wherein the thickness of the dry subbing layer is 0.2 to 0.5 μm.

6. A dye-donor element according to claim 1, wherein the reverse side of said polyethylene terephthalate support has been covered with a slipping layer comprising a lubricating material.

7. A dye-donor element according to claim 1, wherein a dye barrier layer is provided on the subbing layer before the dye/binder layer is applied thereto.

8. A dye-donor element according to claim 1, wherein the reverse side of the polyethylene terephthalate support is provided in the given order with a subbing layer comprising at least one aromatic polyol swelling agent for polyethylene terephthalate and a binder that is soluble in organic solvents and with a slipping layer.

* * * * *